US006677717B2

(12) United States Patent
Park

(10) Patent No.: US 6,677,717 B2
(45) Date of Patent: Jan. 13, 2004

(54) POWER SUPPLY APPARATUS OF LIGHTING SYSTEM USING MICROWAVE

(75) Inventor: Chang-Sin Park, Gyeongsangbuk-Do (KR)

(73) Assignee: LG Electronics Inc. (KR)

( * ) Notice: Subject to any disclaimer, the term of this patent is extended or adjusted under 35 U.S.C. 154(b) by 0 days.

(21) Appl. No.: 10/119,405

(22) Filed: Apr. 8, 2002

(65) Prior Publication Data

US 2003/0164688 A1 Sep. 4, 2003

(30) Foreign Application Priority Data

Mar. 4, 2002 (KR) ..... 2002/11412

(51) Int. Cl.[7] ..... H05B 6/66; H01J 7/46

(52) U.S. Cl. ..... 315/248; 315/276; 315/277; 219/715

(58) Field of Search ..... 315/248, 246, 315/277, 276, 39.51, 94–106, 39, 39.52, 244, 219; 219/715, 716, 721

(56) References Cited

U.S. PATENT DOCUMENTS 4,175,246 A 11/1979 Feinberg et al. ..... 315/101
4,498,029 A 2/1985 Yoshizawa et al. ..... 315/39
5,003,141 A * 3/1991 Braunisch et al. .... 219/10.55 B
5,838,114 A * 11/1998 Penzenstadler et al. ..... 315/277
5,977,530 A * 11/1999 Bessho et al. ..... 219/715

FOREIGN PATENT DOCUMENTS

EP 0794693 A1 9/1997

OTHER PUBLICATIONS

Swedish Office Action against Application No. 0201117–9 dated Jan. 10,2003 citing prior art listed above and English translation thereof.

* cited by examiner

*Primary Examiner*—Wilson Lee
(74) *Attorney, Agent, or Firm*—Ostrolenk, Faber, Gerb & Soffen, LLP

(57) ABSTRACT

A power supply apparatus of a lighting system using microwave includes: a high voltage transformer for transforming a general AC power to an AC power of high voltage and outputting the high voltage AC power; and a voltage doubler unit for transforming the high voltage AC power into a high voltage DC power, increasing the frequency of the current of the DC power, and outputting the DC power having the increased frequency. Since the frequency of the power applied to the magnetron is increased to remove the flicker phenomenon, a stable light can be radiated to an external space.

5 Claims, 5 Drawing Sheets

POWER SUPPLY APPARATUS OF LIGHTING SYSTEM USING MICROWAVE

BACKGROUND OF THE INVENTION

1. Field of the Invention

The present invention relates to a lighting system using microwave, and more particularly, to an apparatus for supplying a power to an electrodeless lighting system using microwave.

2. Description of the Background Art

FIG. 1 illustrates the construction of a lighting system using microwave in accordance with a conventional art.

As shown in FIG. 1, the conventional lighting system using microwave includes: a relay unit 13 for receiving an AC power and passing or cutting off the AC power according to a control signal; a high voltage transformer 14 for transforming the AC power outputted from the relay unit 13 to a DC power supply of high voltage and outputting the transformed power supply; a magnetron 15 for receiving the DC power supply of high voltage and generating a microwave; a waveguide (not shown) for inducing the microwave generated from a magnetron 15; an electrodeless light bulb 16 for generating light by the induced microwave; a controller 11 for generating a control signal; a cooling unit 12 for receiving a power supply from the relay unit 13 and cooling the heat generated from the magnetron 15 and the high voltage transformer 14 by themselves.

The operation of the lighting system using microwave will now be described.

First, the relay unit 13 receives an AC power according to a control signal generated from the controller 11, and passes or cuts off the supplied AC power.

The high voltage transformer 14 transforms the AC power outputted from the relay unit 13, transforms the transformed AC power to a high voltage of DC component, and outputs the transformed high voltage of DC component to the magnetron 15.

The magnetron 15 receives the high voltage of DC component and generates microwave. The microwave is induced to the electrodeless light bulb 16 through the waveguide.

The electrodeless light bulb 16 generates light by the induced microwave, and the generated light is radiated in the forward direction through a reflector (not shown).

However, including a half-wave voltage doubler circuit, the high voltage transformer 14 rectifies the AC power to a DC through the half-wave voltage doubler circuit and supplies it to the magnetron 15.

That is, as the high voltage transformer 14 includes the half-wave voltage doubler circuit that rectifies only a power supply (voltage/current) corresponding to a half of one period of a frequency of a general AC power, a ripple is generated due to the frequency characteristics of the general AC power, which causes a flicker phenomenon.

Namely, since the light generated from the electrodeless light bulb 16 flickers due to the flicker phenomenon, light is not stably radiated.

Consequently, in the high voltage transformer of the lighting system using microwave in accordance with the conventional art, since the power is supplied to the magnetron through the half-wave voltage doubler, the ripple takes place due to the frequency characteristics of the general AC power.

That is, the light generated from the electrodeless light bulb flickers because of the flicker phenomenon caused due to the ripple.

SUMMARY OF THE INVENTION

Therefore, an object of the present invention is to provide a power supply apparatus of a lighting system using microwave that is capable of stably radiating light generated from the light bulb of the lighting system by supplying a stable power to a magnetron of a lighting system using microwave and removing a flicker phenomenon.

To achieve these and other advantages and in accordance with the purpose of the present invention, as embodied and broadly described herein, there is provided a power supply apparatus of a lighting system using microwave including: a high voltage transformer for transforming a general AC power to an high voltage AC power and outputting the high voltage AC power; and a voltage doubler unit for transforming the high voltage AC power into a high voltage DC power, increasing the frequency of the current of the DC power, and outputting the high voltage DC power having the increased frequency.

To achieve the above objects, there is also provided a lighting system using microwave having a high voltage transformer transforming an AC power to a DC power of high voltage, a magnetron receiving the high voltage DC power and generating microwave and an electrodeless light bulb generating light by the microwave, including: a voltage doubler unit for increasing a frequency of the high voltage DC power and applying the high voltage DC power having the increased frequency to the magnetron.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A power supply apparatus of a lighting system using microwave that is capable of radiating a stable light by removing a flicker phenomenon in accordance with a preferred embodiment of the present invention will now be described with reference to FIGS. 2 through 6A and 6B.

Figure 1:
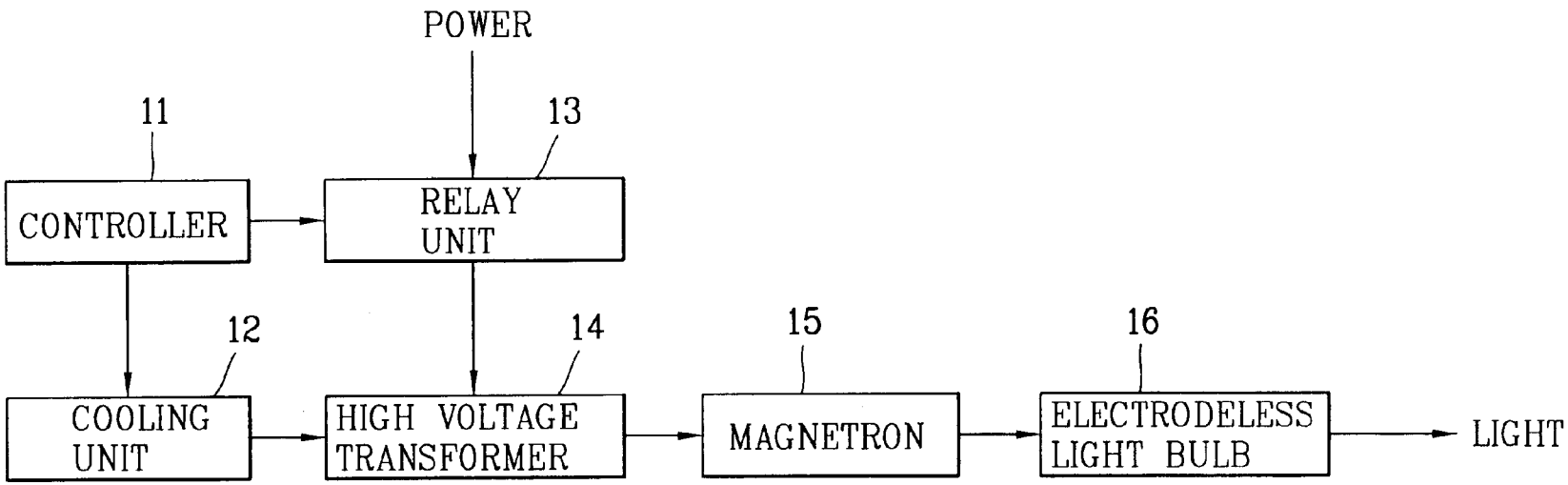
FIG. 1 is a drawing illustrating the construction of a lighting system using microwave in accordance with the conventional art.
Figure 2:
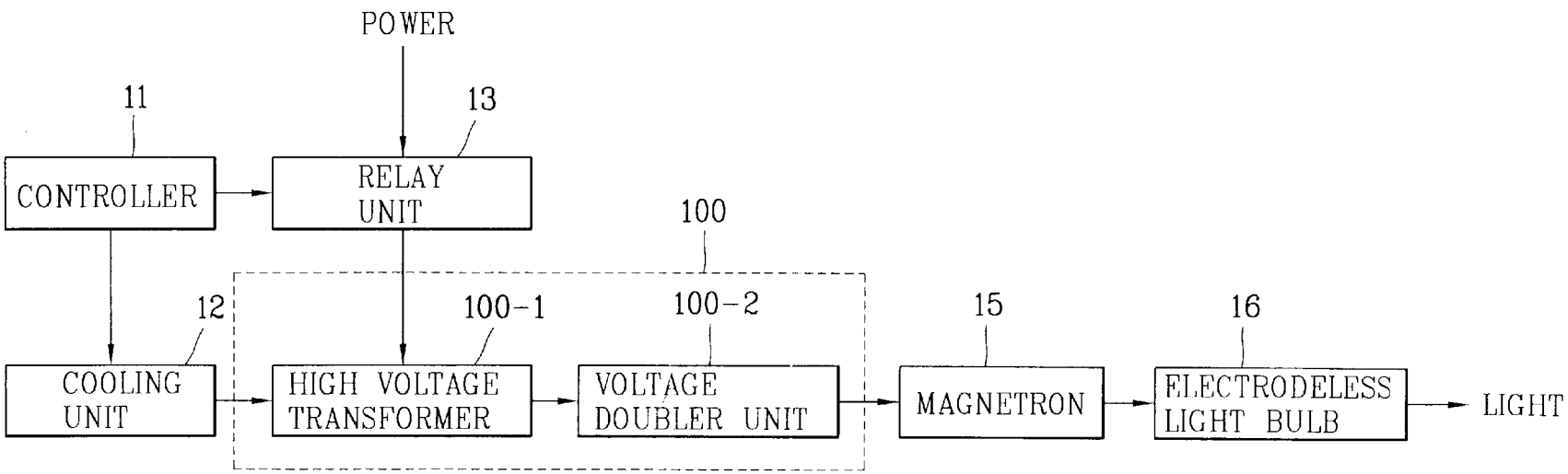
FIG. 2 is a drawing illustrating the construction of a lighting system using microwave in accordance with the present invention.

FIG. 2 is a drawing illustrating the construction of a lighting system using microwave in accordance with the present invention.

As shown in FIG. 2, a lighting system using microwave includes: a relay unit 13 for receiving an AC power, and passing or cutting off the AC power according to a control signal; a power supply apparatus 100 for transforming the AC power outputted from the relay unit 13 to a high voltage DC power, increasing a frequency of the current of the DC power, and generating a high voltage DC power having the increased frequency; a magnetron 15 for receiving the high voltage DC power from the power supply apparatus 100 and generating microwave; a waveguide (not shown) for inducing the microwave generated from the magnetron 15; an electrodeless light bulb 16 for generating light by the induced microwave; a controller 11 for generating a control signal; and a cooling unit 12 for receiving the power from the relay unit 13 and cooling the heat generated from the magnetron 15 and the high voltage transformer 14 by themselves.

The power supply apparatus 100 includes: a high voltage transformer 1001 for transforming the AC power outputted from the relay unit 13 into a high voltage AC power and outputting the transformed AC power; and a voltage doubler unit 100-2 for transforming the transformed AC power into a high voltage DC power so that a stable light without a flicker phenomenon can be radiated from the electrodeless light bulb 16, increasing the frequency of the current of the DC power up to at least more than twice, and applying the high voltage DC power having the increased frequency to the magnetron 15.

The operation of the lighting system using microwave will now be described in detail.

First, the relay unit 13 receives an AC power from an external source and passes or cuts off the supplied AC power according to a control signal generated from the controller 11.

The high voltage transformer 100-1 transforms the AC power outputted from the relay unit 13 into a high voltage AC power and outputs the transformed AC power to the voltage doubler unit 100-2.

Thereafter, the voltage doubler unit 100-2 transforms the AC power into a high voltage DC power so that a stable light (the light without a flicker phenomenon) can be radiated from the electrodeless light bulb 16, increases the frequency of the current of the DC power up to least more than twice, and supplies the high voltage DC power having the increased frequency to the magnetron 15.

In this respect, the frequency is preferably increased to 100 Hz~120 Hz.

That is, the voltage doubler unit 100-2 rectifies a current/voltage flowing for one period of a general frequency transformed by the high voltage transformer 100-1 and increases the frequency to twice.

Accordingly, in order to remove the flicker phenomenon that light radiated from the electrodeless light bulb 16 flickers by the density of current generated from the general frequency, the voltage doubler unit 100-2 increases the frequency of the current applied to the magnetron 15 up to more than 100 Hz~120 Hz.

Thereafter, the magnetron 15 receives the high voltage DC power having the frequency that has been increased by more than twice from the voltage doubler unit 100-2 and generates a microwave.

In this respect, the microwave is induced to the electrodeless light bulb 16 through the waveguide. Then, the electrodeless light bulb 16 outwardly generates a stable light (the light without the flicker phenomenon) by the microwave generated from the magnetron 15.

The light is forwardly radiated through a reflector (not shown).

That is, as a substance sealed in the electrodeless light bulb 16 is emitted, a light having an inherent radiation spectrum is generated from the electrodeless light bulb 16. The light is forwardly reflected by the reflector (not shown) and a mirror (not shown), lighting a space around it.

The construction of the power supply apparatus 100 in accordance with one embodiment of the present invention will now be described with reference to FIG. 3.

Figure 3:
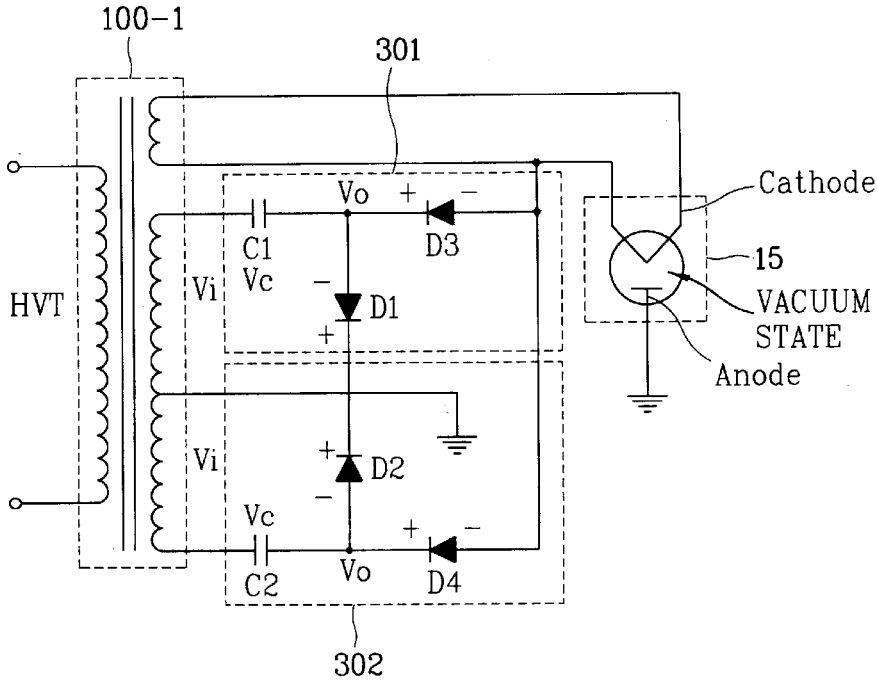
FIG. 3 is a drawing illustrating the construction of a power supply apparatus in accordance with one embodiment of the present invention.

FIG. 3 is a drawing illustrating the construction of a power supply apparatus in accordance with one embodiment of the present invention.

As shown in FIG. 3, the voltage doubler unit 100-2 of the power supply apparatus 100 includes a first circuit unit 301 for transforming the high voltage AC power (voltage/current) transformed by the high voltage transformer 100-1 for one half of one period of the general frequency into a high voltage DC power; and a second circuit unit 302 for transforming the high voltage AC power transformed by the high voltage transformer (HVT) 100-1 for the other half of one period into a high voltage of DC power.

The first circuit unit 301 includes one side of a first capacitor (C1) connected to one output terminal of the high voltage transformer 100-1; a '−' terminal of a first diode (Dl) connected to the other side of the first capacitor (C1); and a '+' terminal of a third diode (D3) connected to the other side of the first capacitor (C1).

The second circuit unit (302) includes one side of a second capacitor connected to the output terminal of the other side of the high voltage transformer (100-1); a '−' terminal of a second diode (D2) connected to the other side of the second capacitor (C2); and a fourth diode (D4) connected to the other side of the second capacitor (C2).

Wherein a '+' terminal of the first diode (D1) is connected to a '+' terminal of the second diode. That is, the voltage doubler unit 100-2 is constructed as a mirror type on the basis of the ground of the high voltage transformer 100-1, and operated for a different period.

For example, the first circuit unit 301 is operated for one half of one period to rectify the power (voltage/current) corresponding to the half of one period, while the second circuit unit 302 is operated for the other half of one period to rectify the power corresponding to the other half of one period. Thus, the frequency of the current (oscillation current) among the DC power characteristics of the high voltage is increased by twice and applied to the magnetron 15.

That is, in order to remove the flicker phenomenon that the light flickers due to the density of the current generated by the general frequency (i.e., 50 Hz or 60 Hz), the frequency of the oscillation current of the magnetron 15 is increased by more than 100 Hz~120 Hz.

In this respect, the first and the second circuit units are called 'half-wave voltage doubler rectifying circuits, and the structure including the first and the second circuit units is called a 'both-wave voltage doubler rectifying circuit'.

Figure 4:
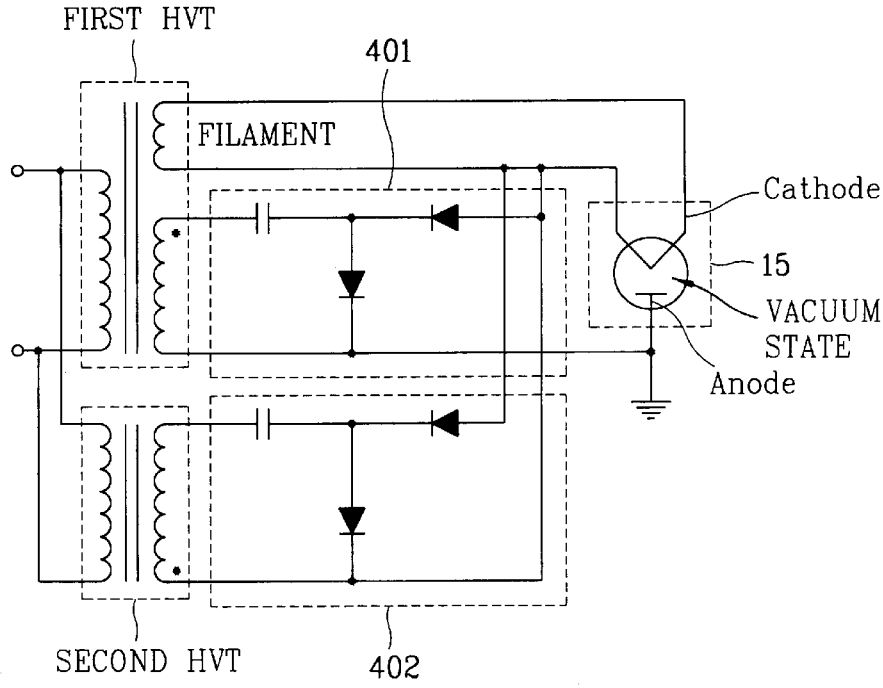
FIG. 4 is a drawing illustrating the construction of a power supply apparatus in accordance with another embodiment of the present invention.

FIG. 4 is a drawing illustrating the construction of a power supply apparatus in accordance with another embodiment of the present invention.

As shown in FIG. 4, the power supply apparatus in accordance with another embodiment of the present invention includes: a first half-wave voltage doubler rectifying circuit 401 connected to a filament connected to a core of the first high voltage transformer (HVT) and the output terminal of the first HVT, a second HVT connected to the input of the first HVT; and a second half-wave voltage doupler rectifying circuit 402 connected to the output terminal of the second HVT.

That is, the power supply apparatus in accordance with the second embodiment of the present invention is constructed in that the both-wave voltage doubler circuits (401, 402) are connected to the two HVTs and operated for different periods.

Likewise in the first embodiment of the present invention, in order to remove the flicker phenomenon that light flickers due to the density of current generated by the general frequency (i.e., 50 Hz or 60 Hz, etc.), the frequency of the oscillation current of the magnetron 15 is increased by more than 100 Hz or 120 Hz.

The operation of the voltage doubler unit (the both-wave voltage doubler rectifying circuit) will now be described with reference to FIG. 5 that showing the waveforms according to time lapse.

Figure 5:
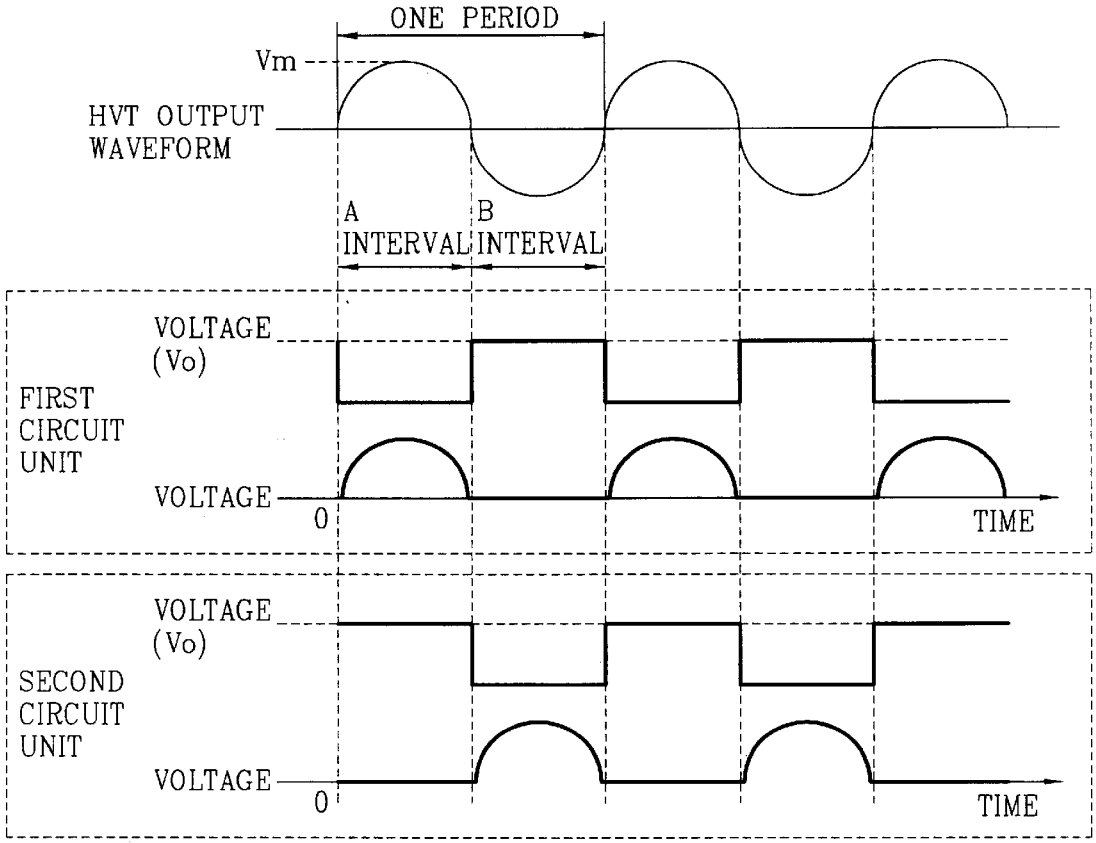
FIG. 5 is a drawing illustrating the operations of a voltage doubler unit as waveforms according to time lapse in accordance with the present invention.

FIG. 5 is a drawing illustrating the operations of a voltage doubler unit as waveforms according to time lapse in accordance with the present invention.

As shown in FIG. 5, when the first circuit unit 301 is operated for 'A' period (a half of one period), the first capacitor (C1) is charged (Vc=Vm), and the voltage in the 'B' interval is V0 (positive voltage)=Vi−Vc=Vi−Vm.

Accordingly, a minus (−) rectifying voltage can be obtained by using a capacitance of the third diode (D3) and the magnetron 15 for '0' peak. In this respect, Vi=Vc and Vo is maintained as '0' potential in the first 'A' interval.

Meanwhile, when the second circuit unit 302 is operated for 'B' period, the second capacitor (C2) is charged and the voltage in 'A' interval is V0=Vi−Vc=Vi−Vm.

That is, a (−) rectifying voltage can be obtained by using the capacity of the fourth diode (D4) and the magnetron 15 for the '0' peak.

In the first 'B' interval, Vi=Vc and V0 is maintained at '0' potential.

In this respect, Vi is an output voltage value of the HVT, Vc is a value of voltage flowing at the first capacitor (C1), Vm is a maximum output voltage value of the HVT, and Vo is a value of voltage flowing at the first and second diodes (D1, D2).

Accordingly, the high voltage DC power is supplied to the magnetron 15 according to the operations of the first and the second circuit units 301 and 302 according to the repetition of the period of the frequency, and the voltage of the DC power is maintained the DC rectifying waveform of (−) a few kV.

That is, the frequency of the current (oscillation current) supplied to the magnetron 15 is transformed by more than twice of the input frequency (general frequency).

Accordingly, the magnetron 15 radiating the microwave is stably oscillated, so that the flicker phenomenon of the electrodeless light bulb 16 can be removed.

The waveform of the voltage and the current supplied to the magnetron 15 will now be described with reference to FIGS. 6A and 6B.

Figure 6A:
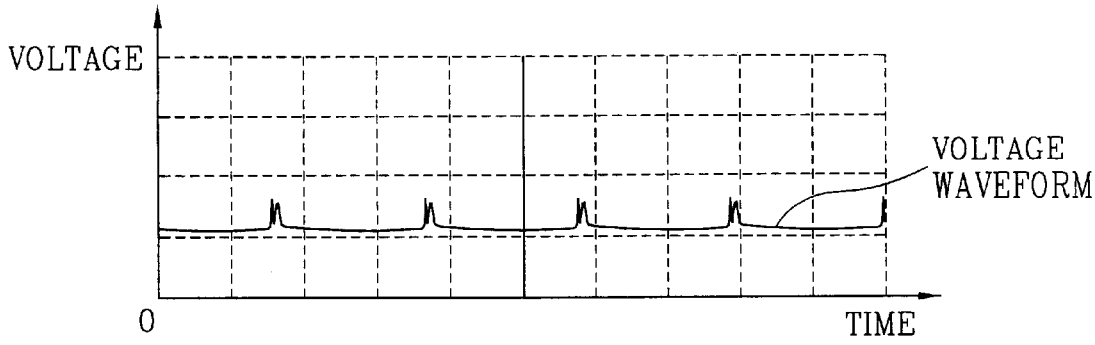
FIGS. 6A and 6B are drawings showing waveforms of voltage and current supplied to the magnetron in accordance with the present invention.
Figure 6B:
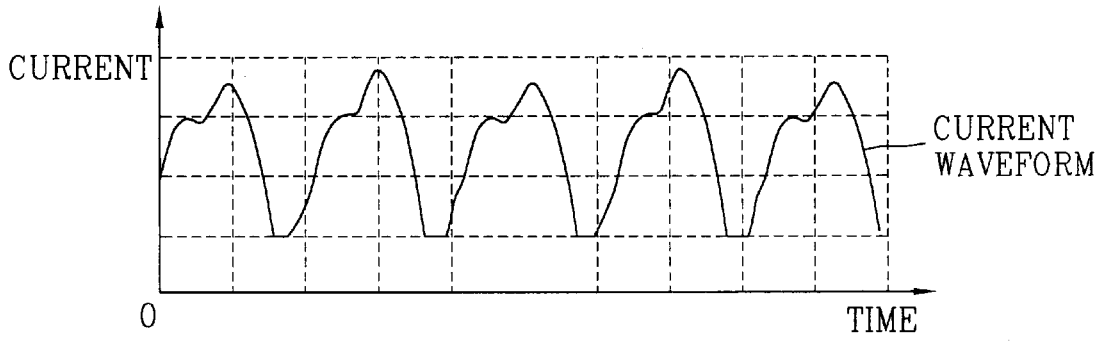

FIGS. 6A and 6B are drawings showing waveforms of voltage and current supplied to the magnetron in accordance with the present invention.

That is, FIG. 6A shows a waveform of a voltage supplied to an anode of the magnetron 15 through the first and the second circuit units 301 and 302 of the voltage doubler unit 100-2, and FIG. 6B shows waveforms of a current applied to the anode of the magnetron 15 through the first and the second circuit units 301 and 302 of the voltage doubler unit 100-2.

As so far described, the power supply apparatus of a lighting system using microwave has an advantage that, since the frequency of the power applied to the magnetron is increased to remove the flicker phenomenon, a stable light can be radiated to an external space.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A lighting system using microwave comprising:

a relay unit for receiving an AC power, and passing or cutting off the AC power according to a control signal;

a high voltage transformer for transforming the AC power outputted from the relay unit into a high voltage AC power and outputting the transformed AC power;

a voltage doubler unit for transforming the high voltage AC power into a high voltage DC power, increasing a frequency of a current of the DC power by at least more than twice, and outputting the high voltage DC power having the increased frequency;

a magnetron for receiving the high voltage DC power from voltage doubler unit and generating microwave;

a waveguide for inducing the microwave;

an electrodeless light bulb for generating a stable light without a flicker phenomenon by the induced microwave; and a controller for generating the control signal.

2. The system of claim 1, wherein the voltage doubler unit rectifies the voltage/current of the positive (+) and the negative (−) period of the frequency of the high voltage AC power in order to increase the frequency.

3. The apparatus of claim 1, wherein the voltage doubler unit includes:

a first circuit unit for rectifying the high voltage AC power transformed from the high voltage transformer for one half of one period of the frequency of the high voltage AC power; and a second circuit unit for rectifying the high voltage AC power transformed by the high voltage transformer for the other half of one period.

4. The apparatus claim 3, wherein the first circuit unit includes:

a first capacitor connected to one output terminal of the high voltage transformer;

a '−' terminal of a first diode connected to the other side of the first capacitor; and a '+' terminal of a third diode connected to the other side of the first capacitor, and the second circuit unit includes:

a second capacitor connected to the output terminal of the other side of the high voltage transformer;

a '−' terminal of a second diode connected to the other side of the second capacitor; and a fourth diode connected to the other side of the second capacitor, wherein a '+' terminal of the first diode is connected to a '+' terminal of the second diode.

5. The system of claim 1, wherein the increased frequency is 100 Hz 120 Hz.

* * * * *